US007678174B2

(12) United States Patent
Tokuoka et al.

(10) Patent No.: US 7,678,174 B2
(45) Date of Patent: Mar. 16, 2010

(54) SOFT MAGNETIC MATERIAL, COMPRESSED POWDER MAGNETIC CORE AND METHOD FOR PRODUCING COMPRESSED POWER MAGNETIC CORE

(75) Inventors: Terukazu Tokuoka, Itami (JP); Kazuhiro Hirose, Itami (JP); Haruhisa Toyoda, Itami (JO); Takao Nishioka, Itami (JP); Kouhei Sawada, Amagasaki (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 338 days.

(21) Appl. No.: 11/574,555

(22) PCT Filed: Aug. 31, 2005

(86) PCT No.: PCT/JP2005/015871

§ 371 (c)(1), (2), (4) Date: Mar. 1, 2007

(87) PCT Pub. No.: WO2006/025430

PCT Pub. Date: Mar. 9, 2006

(65) Prior Publication Data

US 2007/0290161 A1 Dec. 20, 2007

(30) Foreign Application Priority Data

Sep. 1, 2004 (JP) ..... 2004-254650

(51) Int. Cl.
*B22F 3/02* (2006.01)
*H01F 1/26* (2006.01)

(52) U.S. Cl. ..... 75/252; 148/104

(58) Field of Classification Search ..... None
See application file for complete search history.

(56) References Cited

U.S. PATENT DOCUMENTS 6,773,802 B2 * 8/2004 Kobayashi et al. ..... 428/847.4

FOREIGN PATENT DOCUMENTS

| | | | |
|---|---|---|---|
| EP | 0220321 | A1 | 5/1987 |
| EP | 1447824 | A1 | 8/2004 |
| JP | 03-218605 | | 9/1991 |
| JP | 10-501270 | | 2/1998 |
| JP | 2002-212142 | A | 7/2002 |
| JP | 2002-246219 | | 8/2002 |
| JP | 2002-280209 | | 9/2002 |
| JP | 2003-509582 | | 3/2003 |
| JP | 2003-261826 | | 9/2003 |
| JP | 2004-059744 | A | 2/2004 |
| JP | 2004143554 | A | 5/2004 |
| JP | 2004-190051 | | 7/2004 |
| JP | 2004-197212 | | 7/2004 |
| WO | 9903622 | A1 | 1/1999 |
| WO | 03/038843 | | 5/2003 |

* cited by examiner

*Primary Examiner*—George Wyszomierski
(74) *Attorney, Agent, or Firm*—Darby & Darby P.C.

(57) ABSTRACT

A soft magnetic material has an iron based powder that has an insulating coating on the surface and an ester wax. The ester wax is added in an amount not less than 0.02% by weight and not more than 0.6% by weight in relation to the soft magnetic material. Consequently, seizure between a metal mold and a material to be molded at the time of molding can be suppressed and the arising of a black residue can be prevented.

12 Claims, 5 Drawing Sheets

SOFT MAGNETIC MATERIAL, COMPRESSED POWDER MAGNETIC CORE AND METHOD FOR PRODUCING COMPRESSED POWER MAGNETIC CORE

CROSS-REFERENCE TO PRIOR APPLICATIONS

This application is a U.S. national phase application under 35 U.S.C. §371 of International Patent Application No. PCT/JP2005/015871, filed Aug. 31, 2005, and claims the benefit of Japanese Application No. 2004-254650, filed Sep. 1, 2004, both of which are incorporated by reference herein. The International Application was published in Japanese on Mar. 9, 2006 as International Publication No. WO 2006/025430 A1 under PCT Article 21(2).

FIELD OF THE INVENTION

The present invention relates to a soft magnetic material, a compressed powder magnetic core and a method for producing a compressed powder magnetic core.

BACKGROUND OF THE INVENTION

Conventionally, to suppress the seizure of a metal mold and an article to be molded during molding, methods have been used to lower the frictional resistance of the interface between the metal mold and article to be molded using resins that are always solid. Regarding the utilization mode of this resin, the resin may be added to the materials used for the article to be molded or the resin may be sprayed directly onto the metal mold. When the resin is added to the materials, the amount of the resin added needs to be 0.6% by weight or greater in order for the resin near the surface of the article to be molded to contribute to a reduction in frictional resistance with the metal mold. Consequently, this causes a reduction in density of the molded body. In addition, when the resin is sprayed onto the metal mold, it is difficult to uniformly spray it onto the metal mold, especially for a metal mold of a complex shape, and there is a problem with unevenness easily occurring.

To resolve these problems, methods for adding wax-like polymer oils to iron group materials have been proposed. For example, in Japanese Patent Application Publication No. 2003-509582, a lubrication-imparting mechanism that relies on the addition of a polycarboxylic acid amide wax is disclosed, and in Japanese Patent Application Publication No. H10-501270, a lubrication-imparting mechanism that relies on the addition of an amide type oligomer is disclosed.

SUMMARY OF THE INVENTION

Although the amide wax or amide type oligomer described above are shown to be outstanding lubricants, complete decomposition is impossible and there is a problem with a black residue being left over when it is applied to a soft magnetic material for which heat treatment at comparatively low temperatures is required, because the amide bond is strong.

Therefore, it is an object of the present invention to provide a soft magnetic material, a compressed powder magnet core, and a method of manufacturing a compressed powder magnetic core that can suppress the seizure of the metal mold and the article to be molded at the time of molding and can prevent the occurrence of black residue.

Moreover, it is also feasible that the fluidity of the powder mixture is decreased extremely by just adding and mixing in a wax.

Thus, it is a further object of the present invention to provide a soft magnetic material, a compressed powder magnet core, and a method of manufacturing a compressed powder magnetic core that can achieve improved density, improved strength and improved characteristics of a compressed powder magnetic core by improving the fluidity of the powder mixture.

The soft magnetic material of the present invention is characterized by having an iron based powder having an insulating coating on its surface and at least one type of wax that contains an ester wax, where the wax containing an ester wax is included at no less than 0.02% by weight and no more than 0.6% by weight.

By use of the soft magnetic material of the present invention, the seizure of the metal mold and the article to be molded can be suppressed at the time of molding because the lubricating characteristics are improved through the use of the ester wax. Moreover, although it is preferable for the melting temperature range of the ester wax to be particularly narrow (a sharp melting type), the generation of residue due to heat treatment after molding (for example, heat treatment at a temperature above the decomposition temperature of the wax in air) can be prevented because it can be easily broken down by heat treatment at comparatively low temperatures.

The reason the amount of the wax added, which contains the ester wax, is at least 0.02% by weight and no more than 0.6% by weight is that the lubrication ability with the metal mold becomes insufficient and stripes appear on the surface of the molded body if the amount added is less than 0.02% by weight, and when the amount added is greater than 0.6% by weight, it causes a reduction in density and satisfactory soft magnetic characteristics cannot be obtained. The amount of wax added is preferably no more than 0.2% by weight. A high density molded body can be obtained with at least 0.02% by weight and no more than 0.2% by weight.

Thus, the present inventors brought to fruition a soft magnetic material that can suppress the seizure of the metal mold and the article to be molded at the time of molding and that can prevent the generation of black residue by optimizing the type of wax and its amount added.

For the soft magnetic material described above, it is preferable for the wax that contains the ester wax to have an average particle size of 0.5 μm or more and to be smaller than the average particle size of the iron based powder that has an insulating coating.

Normally, an ester wax of several hundred μm to several mm is used. While this is because the hardness of the ester wax is low and it is difficult to grind it, wax of a desirable particle size can be obtained by freezing the wax with liquid nitrogen or the like and grinding it.

Moreover, if the average particle size of the wax is larger than the 200 μm average particle size of the iron based powder, the dispersion of the wax deteriorates and unevenness can result when the wax oozes out in between the metal mold and the molded body. In addition, if the average particle size of the wax is smaller than 0.5 μm, unevenness can result when the wax oozes out due to the wax condensing with each other and consequent deterioration of the mixing of the wax and the soft magnetic material. It is more preferable for the average particle size of the wax to be at least 0.5 μm and no more than 50 μm. It is preferable in the soft magnetic material described above for the wax that contains the ester wax to have a melting point of no more than 100° C.

If the melting point of the wax is more than 100° C., since it is difficult for the temperature of the molded body during normal pressing to rise above 100° C. even when the metal mold temperature is made to be above the melting point of the wax, it is difficult to effect the dissolution and effusion of the wax. Moreover, although it is preferable for the melting point of the wax to be lower, it will dissolve at the time of the powder mixing or during storage if it is too low and this will badly affect the fluidity and the like of the powder. Therefore, a wax that exists in a solid state when the wax is being stored and has a melting point that makes it dissolve when being pressed is preferable. Furthermore, it is preferable to have a melting point for the wax that is no more than 50° C. If it is no more than 50° C., the temperature of the molded body will become greater than 50° C. at the time of pressing because of frictional heat and effusion is realized without forcibly raising the metal mold temperature.

In the soft magnetic material described above, it is preferable for the wax that includes the ester wax to have a viscosity of no more than 15 mPa·s when melted.

The viscosity of the wax is extremely important to the time it takes the wax to effuse to the surface and to the uniformity of the lubricant components on the surface. If the viscosity of the wax is greater than 15 mPa·s, it will not spread uniformly in the interface between the metal mold and the molded body at the time of extraction even if it dissolves during press molding, which becomes a cause of seizure and stripes appearing on the surface of the molded body.

In the soft magnetic material described above it is preferable for a solid lubricant, which exhibits its lubricating characteristics by exfoliating in layers, to be added at no less than 0.0005% by weight and no more than 0.1% by weight.

If the amount of the solid lubricant added is greater than 0.1% by weight, it causes the density and strength of the molded body to be reduced and fluidity deteriorates. This is because solid lubricants have poor lubricating characteristics amongst themselves even though solid lubricants have the action of lowering the frictional resistance of the iron based powder and the wax. Moreover, if the amount of the solid lubricant added is less than 0.0005% by weight, measurement errors become large in relation to variations in the amount added, and characteristics such as the magnetic properties do not stabilize. Thus, by adding an amount of solid lubricant that is no less than 0.0005% by weight and no more than 0.1% by weight, good lubricating characteristics can be achieved for powders that have had their fluidity reduced by the introduction of the wax. It is preferable to add as small an amount of the solid lubricant as possible in order to improve density, improve strength and improve magnetic properties, and in experiments, still better results have been achieved at amounts no more than 0.01%.

In the soft magnetic material described above, it is preferable for the particle size of the solid lubricant to be no more than 1.5 μm.

When the particle size of the solid lubricant is no more than 1.5 μm, the improvement in fluidity is considerable even when only extremely small amounts of the solid lubricant are added. Although the finer the solid lubricant is, the better, it can only be ground to approximately 0.5 μm with current techniques.

In the soft magnetic material described above it is preferable for the solid lubricant to be a metal soap.

In particular, when a trace amount of zinc stearate powder is added, good fluidity is exhibited, and the effects of improved stability in product quality, improved stability in density, improved strength and improved magnetic properties are obtained.

In the soft magnetic material described above, it is preferable to include at least one type of resin selected from a group made up of thermoplastic resins, non-thermoplastic resins, thermosetting resins and non-thermosetting resins. The compressed powder magnetic core of the present invention is produced using the various soft magnetic materials described above and has a density of no less than 7.3 g/cm$^3$. This is so that, by making the density of the molded body no less than 7.3 g/cm$^3$, excellent soft magnetic properties can be achieved. The manufacturing method for the compressed powder magnetic core of the present invention is characterized by being provided with a process that yields a molded body by compression molding, utilizing a metal mold, the various soft magnetic materials described above, where the molding is performed by setting the temperature of the soft magnetic material at or below the melting point of a wax, which contains an ester wax, and by setting the temperature of the metal mold at or above the temperature at which the wax, which contains the ester wax, exists in a liquid state at the interface of the metal mold and the soft magnetic material. In particular, by lowering the melting point of the wax (to no more than 50° C.), effusion will be effected even in cold molding, where the temperature of the powder and the metal mold are not raised.

According to the manufacturing method for the compression powder magnetic core of the present invention, it becomes possible to effuse the wax in a liquid form at the interface during compression molding by establishing the temperature of the soft magnetic material at or below the melting point of the wax and by establishing the temperature of the metal mold at or above the temperature at which the wax exists in a liquid state at the interface between the metal mold and molded body of the compressed powder magnetic core. Consequently, the seizure of the metal mold and the article to be molded during molding can be suppressed.

It is preferable that the manufacturing method for the compressed powder magnetic core described above be further provided with a process that carries out heat treatment of the molded body described above at a temperature at or higher than the decomposition temperature of the wax that contains the ester wax in an air atmosphere.

Thus, the wax component that has solidified after effusing to the surface of the molded body during compression molding is broken down by the heat treatment described above and a good surface condition can be obtained.

As described above. according to the soft magnetic material, compressed powder magnetic core and the manufacturing method of the compressed powder magnetic core of the present invention, the seizure of the metal mold and the article to be molded during molding can be suppressed and the generation of black residue can be prevented.

Moreover, by the addition of a lubricant which exhibits its lubricating properties by exfoliating in layers, the fluidity of the powder mixture is improved and the seizure of the metal mold and the article to be molded during molding can be further suppressed.

DETAILED DESCRIPTION OF THE INVENTION

An embodiment of the present invention is described below based on the drawings.

Figure 1:
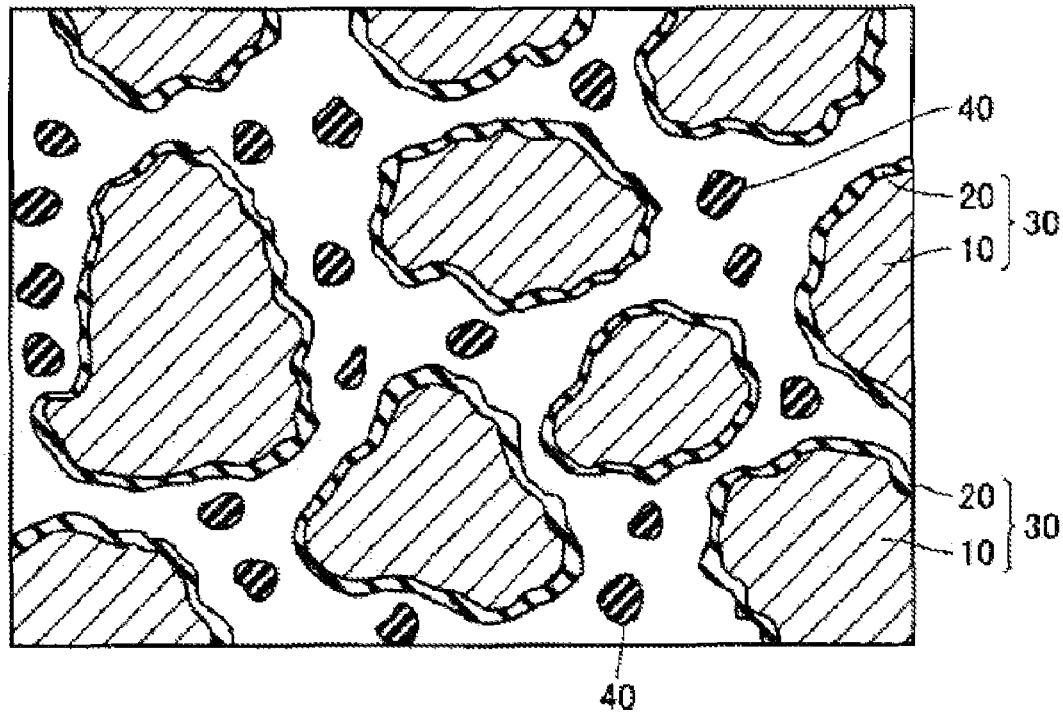
FIG. 1 is a schematic drawing showing the soft magnetic material of an embodiment of the present invention.

FIG. 1 is a schematic drawing that shows a soft magnetic material in an embodiment of the present invention. Referring to FIG. 1, the soft magnetic material is a powder mixture that has, for example, an iron-based powder 30 and an ester wax 40. The iron-based powder 30 is composed of iron-based particles 10 and an insulating coating 20 that is formed on their surface. The ester wax 40 is included in relation to the powder mixture (soft magnetic material) at no less than 0.02% by weight and no more than 0.6% by weight. The iron-based particle 10 is formed, for example from iron (Fe), an iron (Fe)-silicon (Si) alloy, an iron (Fe)-nitrogen (N) alloy, an iron (Fe)-nickel (Ni) alloy, an iron (Fe)-carbon (C) alloy, an iron (Fe)-boron (B) alloy, an iron (Fe)-cobalt (Co) alloy, an iron (Fe)-phosphorus (P) alloy, an iron (Fe)-nickel (Ni)-cobalt (Co) alloy, an iron (Fe)-aluminum (Al)-silicon (Si) alloy or the like. A simple metal or an alloy may be used for the iron-particle 10.

The insulating coating 20 is formed, for example, by phosphate treatment of the iron-based particles 10. Moreover, the insulating coating 20 preferably contains an oxide. In addition to iron phosphate, which includes phosphorus and iron, an oxide insulating body such as manganese phosphate, zinc phosphate, calcium phosphate, aluminum phosphate, silicon oxide, titanium oxide, aluminum oxide or zirconium oxide may be used as the insulating coating 20 that contains this oxide. The insulating coating 20 may be formed in a single layer as shown in the drawing or may be formed in multiple layers. The ester wax 40 is a wax that has ester bonds. An ester bond is a bond that is represented by X—O—R' (where X is an oxoacid from which H has been removed), which hydrolyzes in the presence of an acid or a base, forming an oxoacid and an alcohol.

Among the preferable examples of the ester waxes described above are those described in Published Unexamined Patent Application No. JP2002-212142-A and Published Unexamined Patent Application No. JP2004-059744-A. Specifically, one can list those that can be obtained through condensation reactions of a. a straight chain saturated monocarboxylic acid with a carbon number of 14-30 and b. a straight chain saturated monohydric alcohol with a carbon number of 14-30 or a dihydric-hexahydric polyhydric alcohol with a carbon number of 2-30. These ester waxes are sharp melting type waxes that have a narrow melting point range.

Since in an ordinary ester wax a branched fatty acid or a polyvalent carboxylic acid is also used as component a described above, the viscosity of the ester increases and thus it does not spread uniformly in the boundaries of the metal mold and the molded body at the time of extraction even if it melts at the time of molding, which causes seizure and unsightly appearances such as stripes on the molded body.

Moreover, there is also the problem of residue occurring with a wax that uses a branched fatty acid or a polyvalent carboxylic acid as component a described above compared to a wax that uses a straight chain saturated monocarboxylic acid with a carbon number of 14-30 as component a described above, because it becomes difficult for decomposition to occur during heat treatment.

Therefore, by using a wax that uses a straight chain saturated monocarboxylic acid with a carbon number of 14-30 as component a described above, lubricating effects can be obtained stably, and moreover, even after heat treatment, a good product without a residue can be obtained.

Although there are, in addition to amide waxes, hydrocarbon waxes (paraffin wax, polyethylene wax) for waxes with low melting points or viscosities, ester waxes can be synthesized to have a narrower temperature range for the melting point than these waxes. Therefore, the wax can be melted efficiently in a short period of time, and it can effectively lubricate the boundaries between the metal mold and the molded body.

It is preferable for the average particle size of this ester wax 40 to be no less than 0.5 μm and no more than the average particle size of the iron-based powder 30. In addition, it is preferable for the melting point of the ester wax 40 to be no more than 100° C. Moreover, it is preferable for the viscosity upon melting of the ester wax 40 to be no more than 15 mPa·s.

Moreover, it is preferable for an organic substance (not shown in the drawings) to be included in the soft magnetic material. For this organic substance, a thermoplastic resin such as thermoplastic polyimide, thermoplastic polyamide, thermoplastic polyamide-imide, polyphenylene sulfide, polyamide-imide, polyether sulfone, polyether imide or polyether ether ketone, a non-thermoplastic resin such as all-aromatic polyesters, all-aromatic polyimides or high molecular weight polyethylene, a thermosetting resin, a non-thermosetting resin, or a high fatty acid such as zinc stearate, lithium stearate, calcium stearate, lithium palmitate, calcium palmitate, lithium oleate or calcium oleate may be used. Moreover, these may be mixed together and used. The high molecular weight polyethylene is a polyethylene with a molecular weight of 100,000 or greater.

Figure 2:
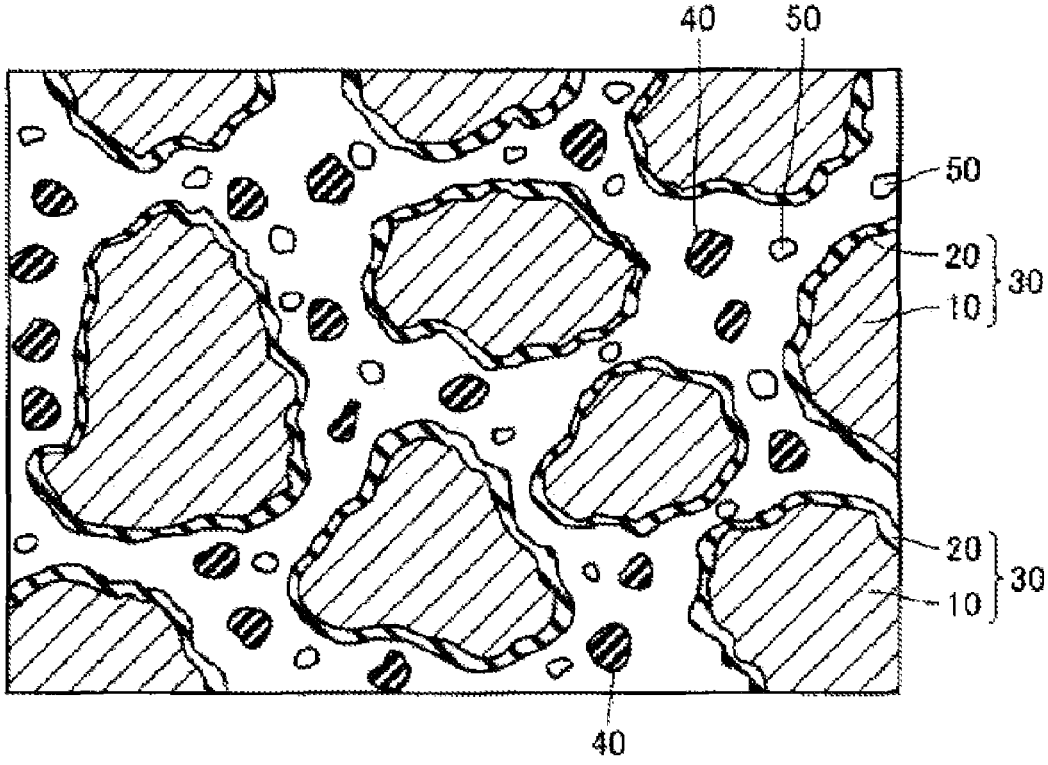
FIG. 2 is a schematic drawing that shows another example (an example where a solid lubricant is added) of the soft magnetic material of an embodiment of the present invention.

Moreover, as shown in FIG. 2, in addition to the iron-base particles 30, the ester wax 40 and the organic substance, it is preferable for the soft magnetic material to have a solid lubricant 50, which exhibits lubrication properties by exfoliating in layers. This solid lubricant 50 is preferably added to the soft magnetic material in amounts no less than 0.0005% by weight and no more than 0.1% by weight.

Moreover, it is preferable for the particle size of solid lubricant 50 to be no more than 1.5 μm. In addition, it is preferable for the solid lubricant 50 to be a metal soap.

Figure 3:
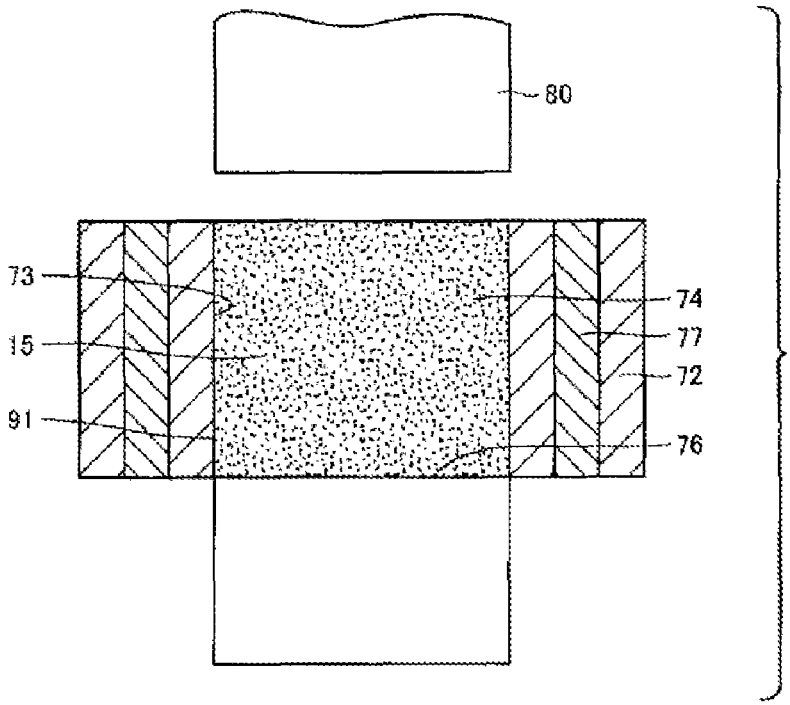
FIG. 3 is a schematic cross-sectional view that shows the first process in the manufacturing method for a compressed powder magnetic core using the soft magnetic material in the embodiment of the present invention.
Figure 4:
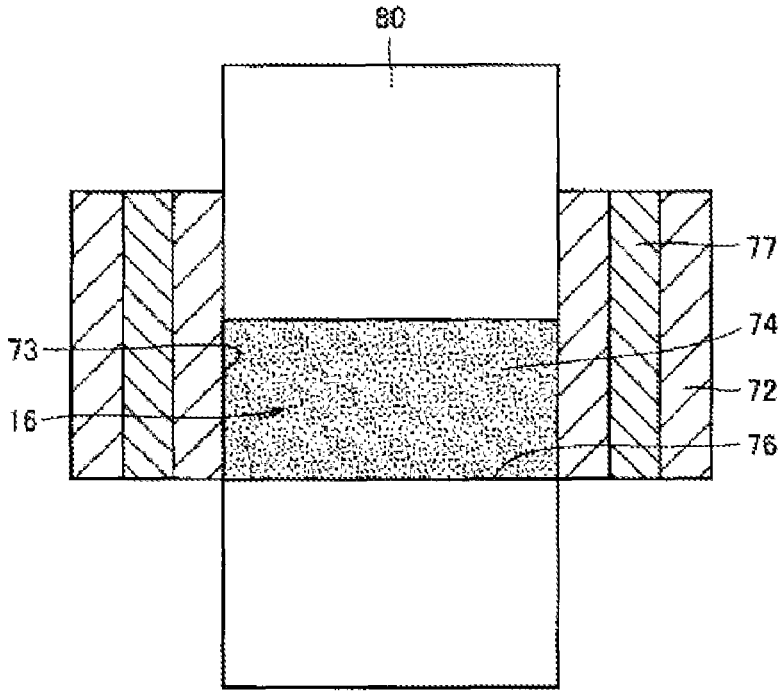
FIG. 4 is a schematic cross-sectional view that shows the second process of the manufacturing method for a compressed powder magnetic core using the soft magnetic material in the embodiment of the present invention.

Next, a manufacturing method for a compressed powder magnetic core that uses the soft magnetic material of the present embodiment will be described. FIG. 3 and FIG. 4 are schematic cross-sectional drawings that show, in the order of the processing, a manufacturing method for a compressed powder magnetic core that uses the soft magnetic material of an embodiment of the present invention. Referring to FIG. 1, the iron-based powder 30 is produced by performing a phosphate treatment on the iron-based particles 10, thereby forming the insulating coating 20 on the surface of the iron-based particles 10. This insulating coating 20 functions as an insulating layer between the iron-based particles 10. By coating the iron-based particles 10 with the insulating coating 20, the electrical resistivity μ of the compressed powder magnetic core can be increased. By this means, the flow of eddy currents between the iron-based particles 10 is suppressed and the loss of iron in the compressed powder magnetic core caused by eddy currents can be reduced.

Moreover, it is preferable for the average thickness of the insulating coating 20 to be no less than 5 nm and no more than 100 nm. The average thickness mentioned here is determined by deriving the corresponding thickness by taking into account the film composition obtained through composition analysis (TEM-EDX: transmission electron microscope energy dispersive X-ray spectroscopy) and the elemental amounts obtained through inductively coupled plasma-mass spectrometry (ICP-MS), and furthermore by directly observing the coating using TEM photography and confirming that the order of magnitude of the corresponding thickness derived above is a proper value. Next, the ester wax 40 is prepared. This ester wax is formed so as to have the average particle size, melting point and viscosity described above.

In addition, the organic substance is prepared. This organic substance is formed as described above from, for example, a thermoplastic resin, a non-thermoplastic resin, a thermosetting resin, a non-thermosetting resin, high fatty acid lubricant, and the like.

Moreover, if a solid lubricant 50 shown in FIG. 2 is to be added, the solid lubricant is also prepared. This solid lubricant is formed from a material that exhibits its lubrication properties by exfoliating in layers.

Using a V-type mixer, the iron-based powder 30, the ester wax 40, the organic substance, and the solid lubricant that is added as necessary are mixed. At this time, the mixing ration is adjusted so that the proportion of the ester wax 40 relative to the powder mixture is no less than 0.02% by weight and no greater than 0.6% by weight. Moreover, the mixing ratio is adjusted so that the proportion of the solid lubricant 50 relative to the powder mixture is no less than 0.0005% by weight and no greater than 0.1% by weight.

There are no particular limitations to the mixing method, and for example, any of mechanical alloying method, a vibratory ball mill, a planetary ball mill, mechanofusion, co-precipitation method, chemical vapor deposition method (CVD method), physical vapor deposition method (PVD method), galvaniztion method, sputtering method, vapor deposition method, or sol-gel method can be used.

Referring to FIG. 3, a pressure molding process is performed on the powder mixture obtained. First, electric power is applied to a band heater 77 of the metal mold device and an inner wall 73 of a mold 72 is heated to a temperature at or above the temperature at which the ester wax 40 will be present in a liquid state at the interface of the inner wall 73 of the mold 72 and the powder mixture. In addition, the temperature of the powder mixture is set at a temperature at or below the melting point of the ester wax 40.

Next, a shoe (not shown in the figure) is positioned above a space 74 that is surrounded by the inner wall 73 and a powder mixture 15 that was obtained in the previous process is supplied to the space 74 from the shoe.

Referring to FIG. 4, a top punch 80 is positioned above the space 74. The top punch 80 is moved downward and the powder mixture 15 is pressure-molded, for example, at a pressure of 700 MPa to 1500 MPa. At this time, an inert gas atmosphere or a reduced pressure atmosphere is preferable for the atmosphere in which the pressure molding is done. In this case, the oxidation of the powder mixture by atmospheric oxygen can be suppressed.

Figure 5:
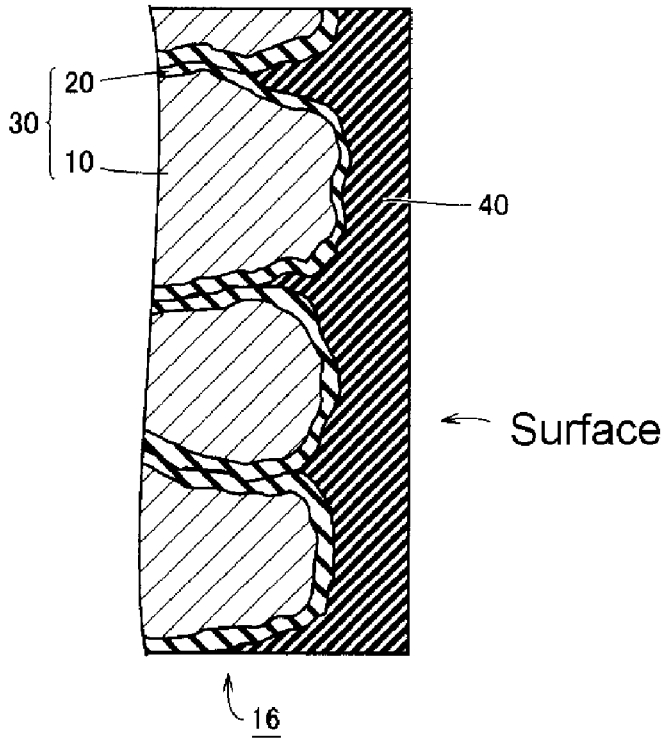
FIG. 5 is a cross-sectional schematic drawing that shows the vicinity of the surface of a molded body that was molded using the soft magnetic material in the embodiment of the present invention.
Figure 6:
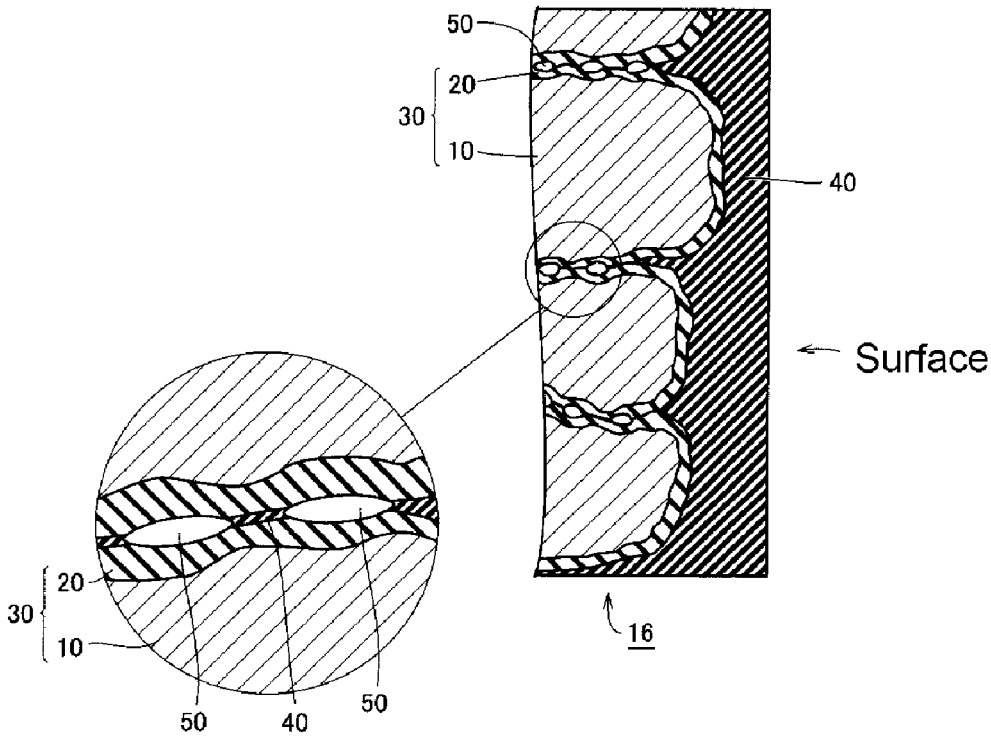
FIG. 6 is a cross-sectional schematic drawing that shows the vicinity of the surface of another example (an example where a solid lubricant is added) of a molded body that was molded using the soft magnetic material in the embodiment of the present invention.

During this pressure molding, the ester wax 40 suppresses the seizure of the inner wall 73 and the powder mixture 15 by effusing as a liquid at the interface of the inner wall 73 of the mold 72 and the powder mixture 15. Furthermore, the solid lubricant 50 makes the powder mixture 15 exhibit good lubricating properties, which has had its fluidity reduced due to the addition of wax, and contributes to improvements in the density, improvements in strength and improvements in the magnetic properties of the molded body because it has the action of lowering the frictional resistance of the iron-based powder 30 and the wax 40. Moreover, the organic substance functions as a lubricant among the iron-based powder 30 and suppresses the introduction of distortion into the iron-based particles 10 during pressure molding and the forceful grinding between and destruction of the insulating coatings 20. Subsequently, a molded body 16 obtained from the pressure molding is removed from the space 74. A cross-sectional schematic drawing that shows the area near the surface of the molded body 16 thus obtained is shown in FIG. 5. Referring to FIG. 5, the molded body 16 is provided with a plurality of insulation coated iron-based particles (iron-based powder) 30 composed of the iron-based particles 10 and the insulating coatings 20 that surround the surfaces of the iron-based particles 10. The ester wax 40 and the organic substance are interposed among the plurality of insulation-coated iron-based particles 30. Each of the plurality of insulation-coated iron-based particles 30 is bound mainly through the organic substance, and besides this, is bound also through the engaging of irregularities the insulation-coated iron-based particles 30 possess. The ester wax 40 has effused to the surface of the molded body 16 and solidified. Moreover, when the solid lubricant 50 is added, the solid lubricant 50 is also interposed among the plurality of insulation-coated iron-based particles 30 as shown in FIG. 6 in addition to the ester wax 40 and the organic substance. However, the amount of the ester wax 40 existing among the insulation-coated iron-based particles 30 is reduced because the ester wax 40 effuses during molding.

Figure 7:
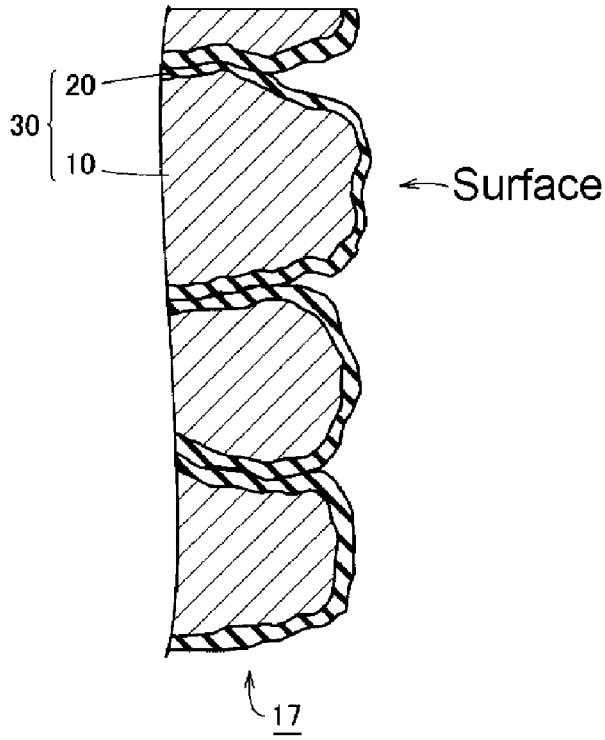
FIG. 7 is a cross-sectional schematic drawing that shows the vicinity of the surface of a heat processed molded body that was molded using the soft magnetic material in the embodiment of the present invention.
Figure 8:
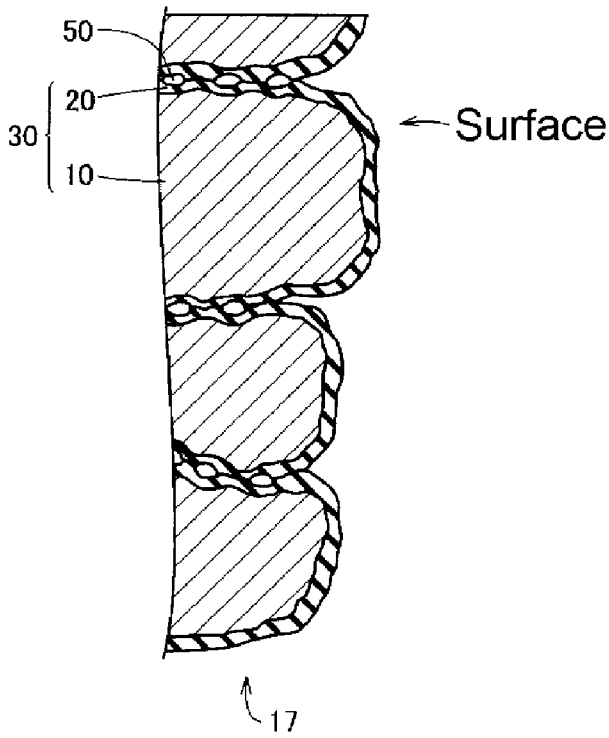
FIG. 8 is a cross-sectional schematic drawing that shows the vicinity of the surface of another example (an example where a solid lubricant is added) of a heat processed molded body that was molded using the soft magnetic material in the embodiment of the present invention.

Next, heat treatment is carried out on the molded body 16 at or above the decomposition temperature of the ester wax 40 in an air atmosphere. This way, the components of the ester wax 40 that has effused to the surface of the molded body 16 during compression molding and then solidified undergo thermal decomposition and a good surface condition is obtained for the molded body 16. The surface of this heat treated molded body 17 which has undergone the heat treatment has the ester wax removed by the thermal decomposition as shown in FIG. 7. Moreover, when the solid lubricant 50 is added, the solid lubricant is also removed as shown in FIG. 7 when the solid lubricant 50 has also been thermally decomposed by the heat treatment described above, even though there are cases where, in addition to the organic substance, the solid lubricant 50 is also interposed among the plurality of insulation-coated iron-based particles 30 as shown in FIG. 8.

Moreover, the distortion and dislocation caused inside the molded body 16 during the pressure molding can be removed by carrying out the heat treatment.

Finally, a compressed powder magnetic core is completed by performing a suitable process, such as extrusion or cutting, on heat treated molded body 17. The compressed powder magnetic core thus obtained preferably has a density of at least 7.3 g/cm$^3$, and because of this an excellent soft magnetic property can be achieved.

In addition, the compressed powder magnetic core produced in this manner may be utilized, for example, for electronic parts such as choke coils, switching power supply devices and magnetic heads, various motor components, or products such as solenoids, various magnetic sensors and various solenoid valves.

Moreover, in the description above, the case of using an ester wax for the wax was described, but the wax can be a wax that contains an ester wax.

Examples of embodiment of the present invention are described below.

Example 1

Somaloy 550 (average particle size 210 μm, measured using a Nikkiso Co. Ltd. particle-size-distribution measuring device) from Höganäs AB was used as an iron-based powder sample. In addition, an ester wax was used for the wax. The ester waxes prepared are the waxes A-I shown in Table 1, and the properties of each of the waxes A-I are shown together in Table 1.

TABLE 1

| | A | B | C | D | E | F | G | H | I |
|---|---|---|---|---|---|---|---|---|---|
| Average particle size (μm) | 0.3 | 0.8 | 12 | 12 | 15 | 14 | 62 | 185 | 212 |
| Melting point (° C.) | 73 | 73 | 42 | 73 | 82 | 77 | 73 | 73 | 73 |
| Viscosity at time of melting (90° C.) (mPa · s) | 7.8 | 7.8 | 4.3 | 7.8 | 13 | 17 | 7.8 | 7.8 | 7.8 |

First, powder mixtures 1-7 in which wax D added in the amounts shown in Table 2 in relation to Somaloy 550 was combined were prepared, and each of the power mixtures 1-7 was mixed for 1 hour with a V-type mixer.

TABLE 2

| | Amount of WAX (D) added (% by weight) |
|---|---|
| 1 | 0.15 |
| 2 | 0.03 |
| 3 | 0.06 |
| 4 | 0.20 |
| 5 | 0.40 |
| 6 | 0.58 |
| 7 | 0.65 |

Next, a metal mold was set to each of the temperatures shown in Table 3, press molding with a thickness 30 mm was carried out using a 20 mm diameter (ϕ) metal mold, and the surface conditions of the molded shape were evaluated. Moreover, the press pressure was 1000 MPa. The evaluations of the surface conditions obtained are shown together in Table 3.

TABLE 3

| | Metal Mold Temperature | | | |
|---|---|---|---|---|
| Wax Addition | I Room Temperature | II 40° C. | III 90° C. | IV 120° C. |
| 1 | X | X | Y | Y |
| 2 | X | X | Z | Z |
| 3 | X | X | Z | Z |
| 4 | X | X | Z | Z |
| 5 | X | X | Z | Z |
| 6 | X | X | Z | Z |
| 7 | X | X | Z | Z |

In Table 3 above, X indicates that there were stripes because of seizure, Y indicates that there were stripes but only a few, and Z indicates that there were no stripes. In addition, the Y and Z samples had the dissolved wax in a state of adhering on the surface of the molded body. It can be assumed that due to this effect it was possible to prevent seizure during molding and obtain a good surface condition.

From the above results, it was found that when molding was carried out at or above the melting point of the wax, molded bodies having extremely good surface conditions could be obtained even under pressing conditions where there ordinarily would have been seizure.

In addition, it can be assumed that since the lubrication abilities with the metal mold became insufficient due to lack of wax when the amount of wax added was less than 0.02% by weight as in sample 1, stripes appeared on the surface of the molded body.

Next, measurements were performed on the densities related to conditions III (metal mold temperature: 90° C.) and IV (metal mold temperature: 120° C.) for samples 2-7, for which the molding characteristics were found to be excellent. The results are given in Table 4.

TABLE 4

| | Density (g/cm$^3$) | |
|---|---|---|
| | III | IV |
| 2 | 7.62 | 7.65 |
| 3 | 7.61 | 7.65 |
| 4 | 7.56 | 7.60 |
| 5 | 7.53 | 7.56 |
| 6 | 7.50 | 7.54 |
| 7 | 7.40 | 7.43 |

According to the results in Table 4, one can see that a higher metal mold temperature is preferable within the range of pressability, and adding an amount of wax that is no more than 0.6% by weight is desirable for achieving higher density.

Example 2

As in Example 1, waxes A, B, D, G, H and I were added in an amount of 0.2% by weight to Somaloy 550 and combined to prepare powder mixtures, each of these powder mixtures was mixed for 1 hour with a V-type mixer, and molding evaluations were carried out on the samples obtained thereby using a 20 mm diameter (ϕ) metal mold with the metal mold temperature set at 90° C. Moreover, the press pressure was 1000 MPa. The surface conditions and densities of these molded bodies are given in Table 5.

TABLE 5

| | Surface Condition | Density (g/cm$^3$) |
|---|---|---|
| A | Z | 7.45 |
| B | Z | 7.56 |
| D | Z | 7.58 |
| G | Z | 7.55 |
| H | Z | 7.50 |
| I | Y | 7.46 |

From the results in Table 5, it can be seen that the densities of waxes A and I are lower than those of the other waxes. For wax A, it can be assumed that the cause is the average particle size of the wax being too small at 0.3 μm, leading to aggregation. Therefore, if it is possible to have a good dispersion of the wax, it will also be possible to obtain a high density molded body. For sample I, it can be thought that because the wax particles, at 212 μm, were larger than the average particle size of the Somaloy 550 iron-based powder, a sufficient amount of wax was not present on the surface of the molded body and stripes thereby appeared on the surface. Furthermore, because sufficient wax did not effuse between the molded body and the metal mold, the wax remained inside the molded body, which can be thought to have caused a lowering of the density.

Because of this, it is understood that it is preferable to have an average particle size for the wax no less than 0.5 μm and no more than the average particle size of the iron-based powder having an insulating coating.

Example 3

As in Example 2, waxes C, D, E and F were added in an amount of 0.2% by weight to the Somaloy 550 and combined to prepare the powder mixtures, each of these powder mixtures was mixed for 1 hour with a V-type mixer, and molding evaluations were carried out on the samples obtained thereby using a 20 mm diameter (ϕ) metal mold with the metal mold temperature set to 90° C. The press pressure was 1000 MPa. The surface conditions and densities of these molded bodies are given in Table 6.

TABLE 6

| | Surface Condition | Density (g/cm$^3$) |
|---|---|---|
| C | Z | 7.60 |
| D | Z | 7.57 |
| E | Z | 7.55 |
| F | Y | 7.50 |

From the results above, when the viscosity of the wax at the time of dissolution is greater than 15 mPa·s, as with 17 mPa·s, because the viscosity is high and it takes time until effusion occurs during press molding, the amount that is left behind inside the molded body becomes large. In addition, the ability to prevent seizure deteriorates as well as a phenomenon where the density does not rise occurs. Since viscosity is reduced by raising the temperature, a possible solution is raising the temperature of the metal mold. However, there are limits to the temperatures to which the metal mold can be heated when presses are used, so it is preferable to use a wax that exhibits low viscosity (no more than 15 mPa·s) at low temperatures. Moreover, when the molding was carried out with wax C with the metal mold temperature at normal temperature (cold molding) and the other conditions the same, density and surface conditions substantially the same as those when the metal mold temperature was 90° C. were obtained so effusion was confirmed even with cold molding when the melting point of the wax was not greater than 50° C. Thus, it was found that a molded body with high density and good surface conditions could be formed.

Example 4

When press molding was performed at 90° C. using an amide wax, paraffin and oleic acid that exhibited particle sizes, melting points and viscosity behavior upon melting substantially the same as those of wax D, with samples prepared by the same processes as in Examples 1-3, molded bodies with the same good surface qualities as when wax D was used and a high density of 7.58 g/cm$^3$ were obtained. Subsequently, these samples that used amide wax, paraffin and oleic acid were placed in a heat treatment furnace at the same time as a sample using wax D, and heat treatment was carried out at 500° C. in air. As a result, it was found that the waxes were left behind as black residue after heat treatment for the samples using amide wax, paraffin and oleic acid as opposed to the clean decomposition and volatilization of the wax adhering to the surface for the sample using wax D. Although the black residue can be removed by brushing or the like, the use of ester wax is desirable when considering mass production.

Example 5

A metal soap (zinc stearate) was further added as a solid lubricant, changing the average particle sizes and amounts to be added in various ways, to a soft magnetic material produced by adding 0.2% by weight of wax D to Somaloy 550 and mixing for 1 hour with a V-type mixer, and these were further mixed for 1 hour with a V-type mixer. The average particle sizes of the solid lubricant were set respectively at 0.8 μm, 1.3 μm, 2.0 μm and 15 μm, and the amounts of the solid lubricant added for each of the average particle sizes were varied as shown in FIG. 9 and FIG. 10.

Figure 9:
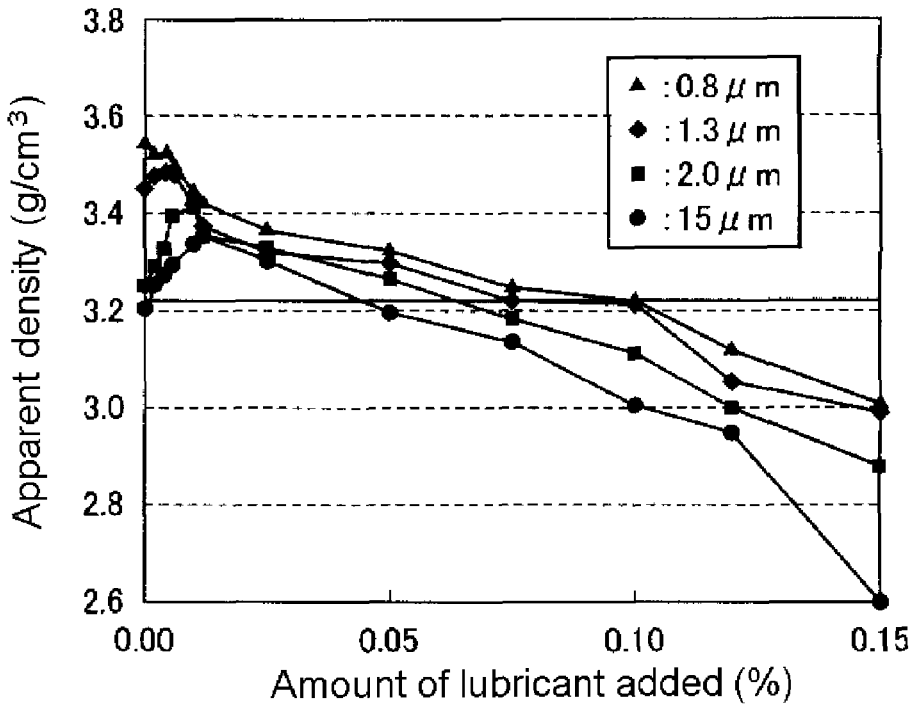
FIG. 9 is a drawing that shows the results of measuring the apparent density of the powder mixture when the amounts of the solid lubricants added for various average particle sizes were changed.

The results of measuring the apparent density of each of the powder mixtures obtained in this way are shown in FIG. 9. Moreover, the results of evaluating the fluidity by measuring the time required for 50 g of the powder mixture described above to fall through a tube with a 4 mm diameter (ϕ) orifice in which it is placed are shown in FIG. 10.

Figure 10:
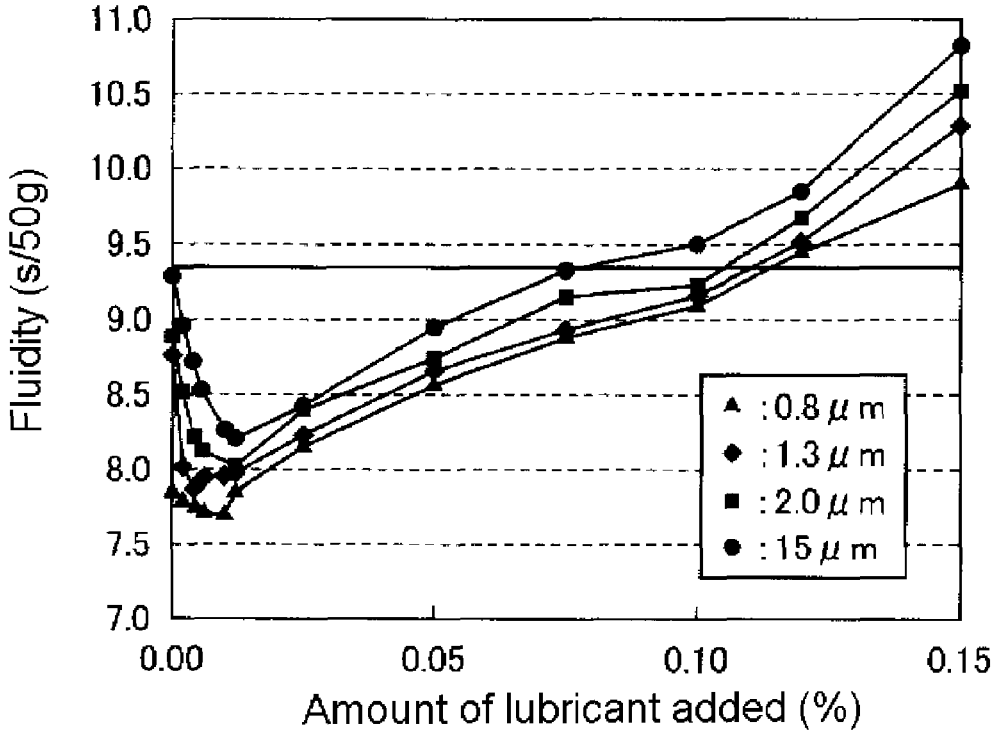
FIG. 10 is a drawing that shows the results of evaluating the fluidity of the powder mixture when the amounts of the solid lubricants added for various average particle sizes were changed.

From the results in FIG. 9 and FIG. 10, it can be seen based on the results of evaluations of apparent density and fluidity that when the amount added of the metal soap that is a lubricant is no more than 0.1% by weight, there are cases in which the apparent density and fluidity are the same as or better than when a lubricant is not added. Even when the amount of wax is changed, these tendencies are the same, and with an amount of wax added that is within the scope of the present invention, it is preferable that the metal soap be in the range of 0.0005% by weight and 0.1% by weight.

Moreover, when the amount of the metal soap added is no more than 0.05% by weight, the apparent density is better than when no lubricant is added for each of the average particle sizes of 0.8 μm, 1.3 μm, 2.0 μm and 15 μm. In addition, when the amount of the metal soap added is no more than 0.075% by weight, the fluidity is better than when no lubricant is added for each of the average particle sizes of 0.8 μm, 1.3 μm, 2.0 μm and 15 μm. These improvements in apparent density and fluidity are indispensable to the stability (suppression of density dispersion) of the product, and when the amount added is smaller than 0.0005% by weight, measurement errors in relation to changes in the amount added become large, and characteristics such as the magnetic properties do not stabilize. Therefore, it is preferable that the amount added be not less than 0.0005% by weight.

Moreover, when h-BN (hexagonal boron nitride), which is known as a layered lubricant, was added, the same results in apparent density and fluidity were obtained as well.

Since these soft magnetic powders have particularly excellent magnetic properties when the density is not less than 7.3 g/cm$^3$, it is preferable to make the density of the molded body 7.3 g/cm$^3$ or greater.

It should be noted that the embodiments and examples disclosed herein are illustrations in all points and do not create limitations. The scope of the present invention is shown not by the descriptions above but by the scope of the claims, and all variations within the meaning and scope equivalent to the scope of the claims are intended to be included.

The present invention can be advantageously applied in particular to soft magnetic materials that have an iron-based powder having an insulating coating on their surfaces, to compressed powder magnetic cores that can be obtained by molding the soft magnetic material, to the molding process for the compressed powder magnetic core, and to heat processed molded bodies where heat treatment has been performed on compressed powder magnetic cores.

The invention claimed is:

1. A compressed powder magnetic core comprising a soft magnetic material and manufactured by compacting the soft magnetic material, wherein the soft magnetic material comprises:

an iron-based powder that has an insulating coating on its surfaces; and at least 1 type of wax that comprises an ester wax;

wherein the soft magnetic material comprises at least 0.02% by weight and no more than 0.6% by weight of said wax that comprises said ester wax, wherein the average particle size of said wax that comprises said ester wax is at least 0.5 μm and no more than the average particle size of said iron based powder that has said insulating coating, and wherein, the wax that comprises said ester wax is interposed between particles of the iron based powder.

2. The compressed powder magnetic core of claim 1, wherein the melting point of said wax that comprises said ester wax is no more than 100° C.

3. The compressed powder magnetic core of claim 1, wherein the viscosity upon melting of said wax that comprises said ester wax is no more than 15 mPa·s.

4. The compressed powder magnetic core of claim 1, further comprising at least 0.0005% by weight and no more than 0.1% by weight of a solid lubricant that exhibits lubrication by exfoliating in layers.

5. The compressed powder magnetic core of claim 4, wherein the particle size of said solid lubricant is no more than 1.5 μm.

6. The compressed powder magnetic core of claim 4, wherein said solid lubricant is a metal soap.

7. The compressed powder magnetic core of claim 1, further comprising at least 1 of a thermoplastic resin, a non-thermoplastic resin, a thermosetting resin, or a non-thermosetting resin.

8. A compressed powder magnetic core manufactured by using the soft magnetic material according to claim 1 and having a density of at least 7.3 g/cm$^3$.

9. The compressed powder magnetic core of claim 1, wherein the insulating coated is formed by phosphate treatment of the iron-based particles.

10. The compressed powder magnetic core of claim 1, wherein the compressed powder magnetic core has a density of 7.3 g/cm$^3$.

11. A method of manufacturing a compressed powder magnetic core, comprising the steps of:

producing a molded body by compression molding the soft magnetic material according to claim 1 utilizing a metal mold; and setting a temperature of said soft magnetic material for said molding below the melting point of said wax that comprises said ester wax and the temperature of said metal mold set so that it is at or above the temperature at which said wax that comprises said ester wax exists in a liquid state at the interface of said metal mold and said soft magnetic material.

12. The method of manufacturing a compressed powder magnetic core according to claim 11, further comprising the step of carrying out heat treatment of said molded body at or above the decomposition temperature of said wax that comprises said ester wax in an air atmosphere.

* * * * *

UNITED STATES PATENT AND TRADEMARK OFFICE

CERTIFICATE OF CORRECTION

PATENT NO. : 7,678,174 B2
APPLICATION NO. : 11/574555
DATED : March 16, 2010
INVENTOR(S) : Tokuoka et al.

It is certified that error appears in the above-identified patent and that said Letters Patent is hereby corrected as shown below:

On the Cover Page:

In the Title:

Replace the title with:

SOFT MAGNETIC MATERIAL, COMPRESSED POWDER MAGNETIC CORE AND METHOD FOR PRODUCING COMPRESSED POWDER MAGNETIC CORE.

In the Specification:

At column 1, lines 1-4, replace the title with:

SOFT MAGNETIC MATERIAL, COMPRESSED POWDER MAGNETIC CORE AND METHOD FOR PRODUCING COMPRESSED POWDER MAGNETIC CORE.

Signed and Sealed this

Fifteenth Day of June, 2010

David J. Kappos

David J. Kappos
*Director of the United States Patent and Trademark Office*